US006402007B1

(12) United States Patent
Dyer

(10) Patent No.: US 6,402,007 B1
(45) Date of Patent: Jun. 11, 2002

(54) PUNCH TOOL

(76) Inventor: Russell O. Dyer, 7205 Tacoma Ave. South, Tacoma, WA (US) 98408

( * ) Notice: Subject to any disclaimer, the term of this patent is extended or adjusted under 35 U.S.C. 154(b) by 115 days.

(21) Appl. No.: 09/602,242

(22) Filed: Jun. 23, 2000

(51) Int. Cl.[7] ..... B25C 1/04
(52) U.S. Cl. ..... 227/147; 227/113; 227/119
(58) Field of Search ..... 227/113, 147, 227/119

(56) References Cited

U.S. PATENT DOCUMENTS

| | | | | | |
|---|---|---|---|---|---|
| 225,482 | A | * | 3/1880 | Mower | 227/147 |
| 539,065 | A | * | 5/1895 | Lombard | 227/147 |
| 541,038 | A | * | 6/1895 | Clark | 227/147 |
| 650,600 | A | * | 5/1900 | Dalpe | 227/147 |
| 1,589,127 | A | | 6/1926 | Deveault | |
| 2,258,861 | A | * | 10/1941 | Park et al. | 227/147 |
| 2,432,176 | A | | 12/1947 | Schubring | |
| 2,545,237 | A | | 3/1951 | Maby | |
| 2,713,905 | A | | 7/1955 | Hartley | |
| 4,041,558 | A | | 8/1977 | Victor | |
| 4,448,339 | A | * | 5/1984 | Pettigrew | 227/147 |
| 4,676,424 | A | * | 6/1987 | Meador et al. | 227/147 |
| 5,123,584 | A | * | 6/1992 | Harrison | 227/147 |
| D408,255 | S | | 4/1999 | Chen | |
| 6,036,073 | A | * | 3/2000 | Newhouse | 227/147 |

* cited by examiner

*Primary Examiner*—Scott A. Smith

(57) ABSTRACT

A punch tool for starting and driving fasteners into a structure. The punch tool includes an elongate housing including a first end having an opening therethrough and also including a second end having an opening therethrough and further including a bore extending therethrough; and also includes a handle member securely attached about the elongate housing near the first end thereof; and further includes a fastener holding member being attached to the second end of the elongate housing; and also includes a punching assembly for punching a fastener being held by the fastener holding member.

12 Claims, 3 Drawing Sheets

PUNCH TOOL

BACKGROUND OF THE INVENTION

1. Field of the Invention

The present invention relates to a start and set punch and more particularly pertains to a new punch tool for starting and driving fasteners into a structure.

2. Description of the Prior Art

The use of a start and set punch is known in the prior art. More specifically, a start and set punch heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 1,589,127; U.S. Pat. No. 2,545,237; U.S. Pat. No. 2,713,905; U.S. Pat. No. 2,432,176; U.S. Pat. No. 4,041,558; and U.S. Pat. No. Des. 408,255.

While these devices fulfill their respective, particular objectives and requirements, the aforementioned patents do not disclose a new punch tool. The inventive device includes an elongate housing including a first end having an opening therethrough and also including a second end having an opening therethrough and further including a bore extending therethrough; and also includes a handle member securely attached about the elongate housing near the first end thereof; and further includes a fastener holding member being attached to the second end of the elongate housing; and also includes a punching assembly for punching a fastener being held by the fastener holding member.

In these respects, the punch tool according to the present invention substantially departs from the conventional concepts and designs of the prior art, and in so doing provides an apparatus primarily developed for the purpose of starting and driving fasteners into a structure.

SUMMARY OF THE INVENTION

In view of the foregoing disadvantages inherent in the known types of start and set punch now present in the prior art, the present invention provides a new punch tool construction wherein the same can be utilized for starting and driving fasteners into a structure.

The general purpose of the present invention, which will be described subsequently in greater detail, is to provide a new punch tool which has many of the advantages of the start and set punch mentioned heretofore and many novel features that result in a new punch tool which is not anticipated, rendered obvious, suggested, or even implied by any of the prior art start and set punch, either alone or in any combination thereof.

To attain this, the present invention generally comprises an elongate housing including a first end having an opening therethrough and also including a second end having an opening therethrough and further including a bore extending therethrough; and also includes a handle member securely attached about the elongate housing near the first end thereof; and further includes a fastener holding member being attached to the second end of the elongate housing; and also includes a punching assembly for punching a fastener being held by the fastener holding member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new punch tool which has many of the advantages of the start and set punch mentioned heretofore and many novel features that result in a new punch tool which is not anticipated, rendered obvious, suggested, or even implied by any of the prior art start and set punch, either alone or in any combination thereof.

It is another object of the present invention to provide a new punch tool which may be easily and efficiently manufactured and marketed.

It is a further object of the present invention to provide a new punch tool which is of a durable and reliable construction.

An even further object of the present invention is to provide a new punch tool which is susceptible of a low cost of manufacture with regard to both materials and labor, and which accordingly is then susceptible of low prices of sale to the consuming public, thereby making such punch tool economically available to the buying public.

Still yet another object of the present invention is to provide a new punch tool which provides in the apparatuses and methods of the prior art some of the advantages thereof, while simultaneously overcoming some of the disadvantages normally associated therewith.

Still another object of the present invention is to provide a new punch tool for starting and driving fasteners into a structure.

Yet another object of the present invention is to provide a new punch tool which includes an elongate housing including a first end having an opening therethrough and also including a second end having an opening therethrough and further including a bore extending therethrough; and also includes a handle member securely attached about the elongate housing near the first end thereof; and further includes a fastener holding member being attached to the second end of the elongate housing; and also includes a punching assembly for punching a fastener being held by the fastener holding member.

Still yet another object of the present invention is to provide a new punch tool that allows the users to easily and conveniently set and start a nail into a structure.

Even still another object of the present invention is to provide a new punch tool that is easy and convenient to use and saves the user from striking one's own hand with the hammer.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
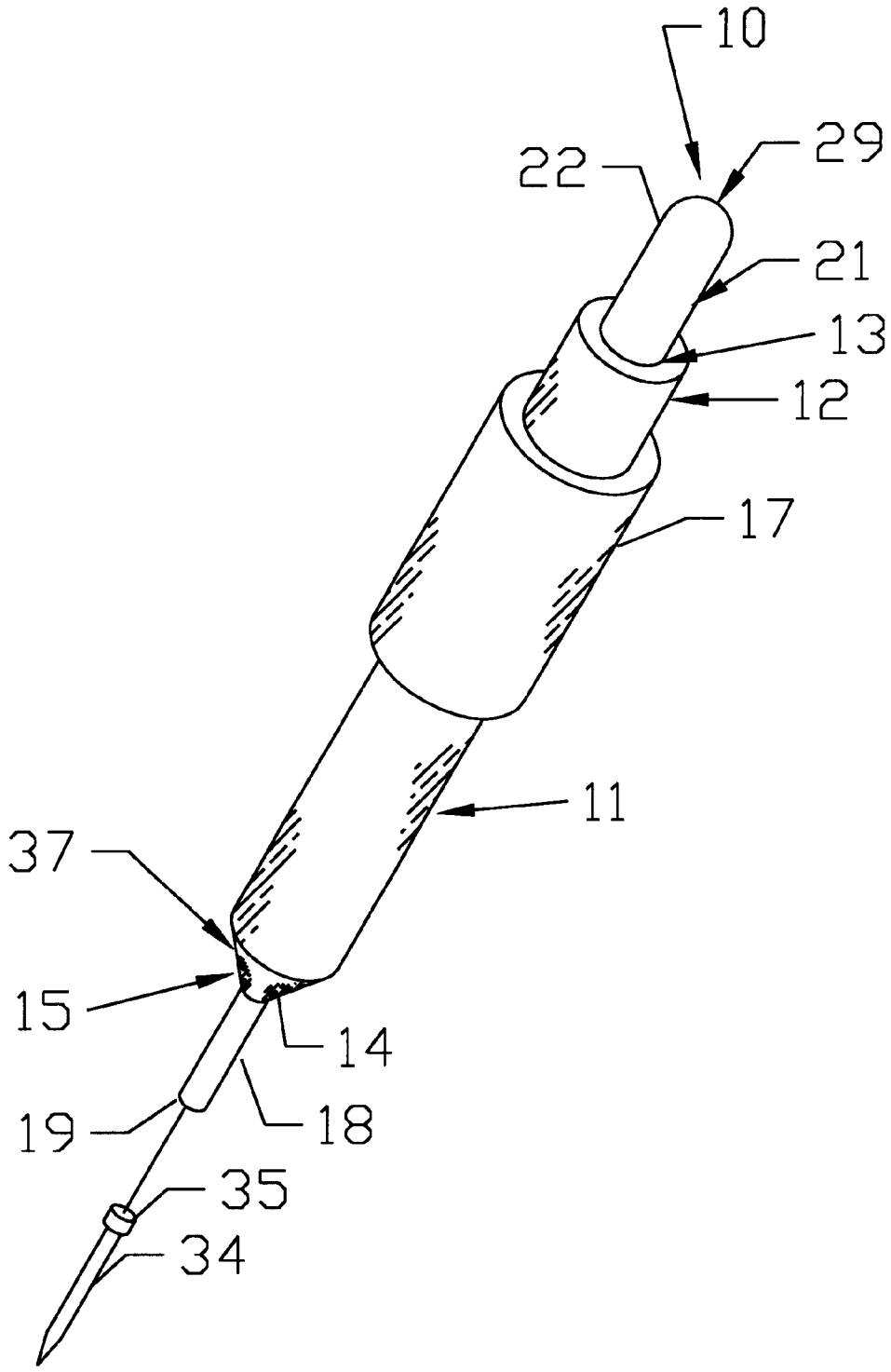
FIG. 1 is a perspective view of a new punch tool according to the present invention.
Figure 2:
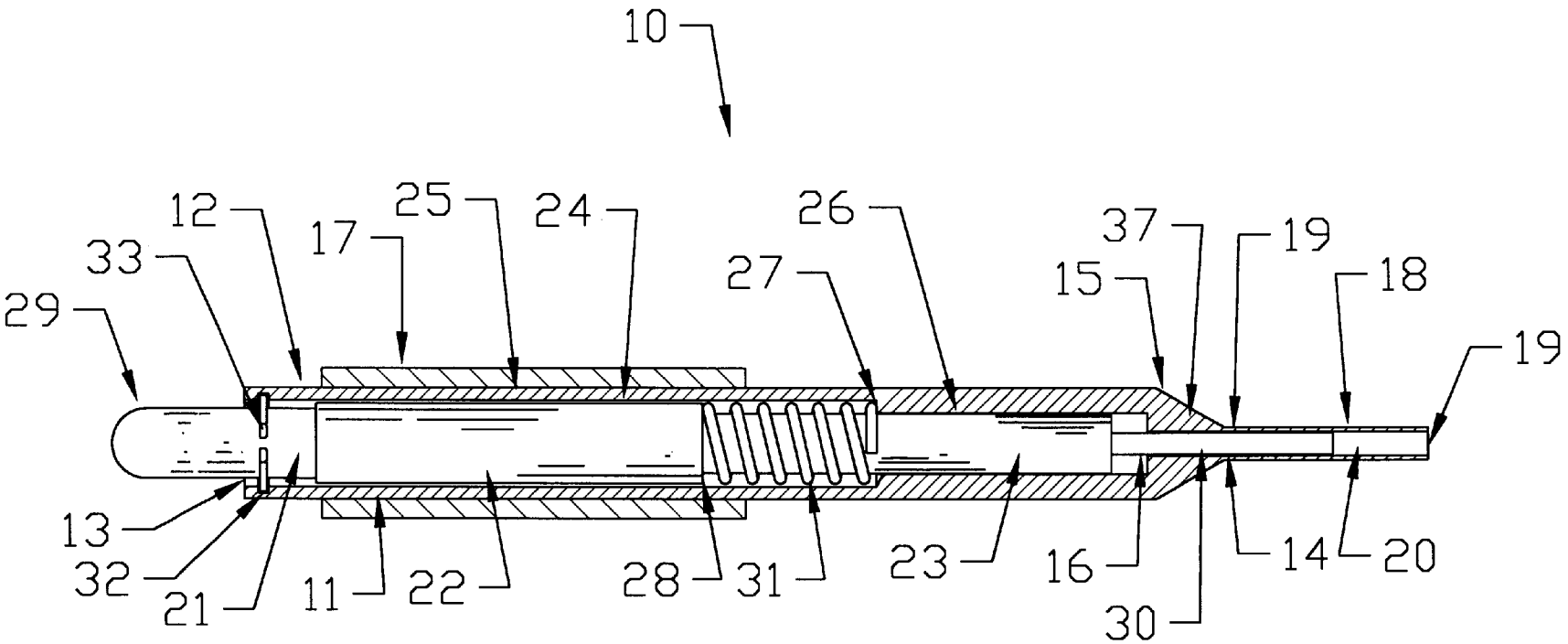
FIG. 2 is a cross-sectional view of the present invention.
Figure 3:
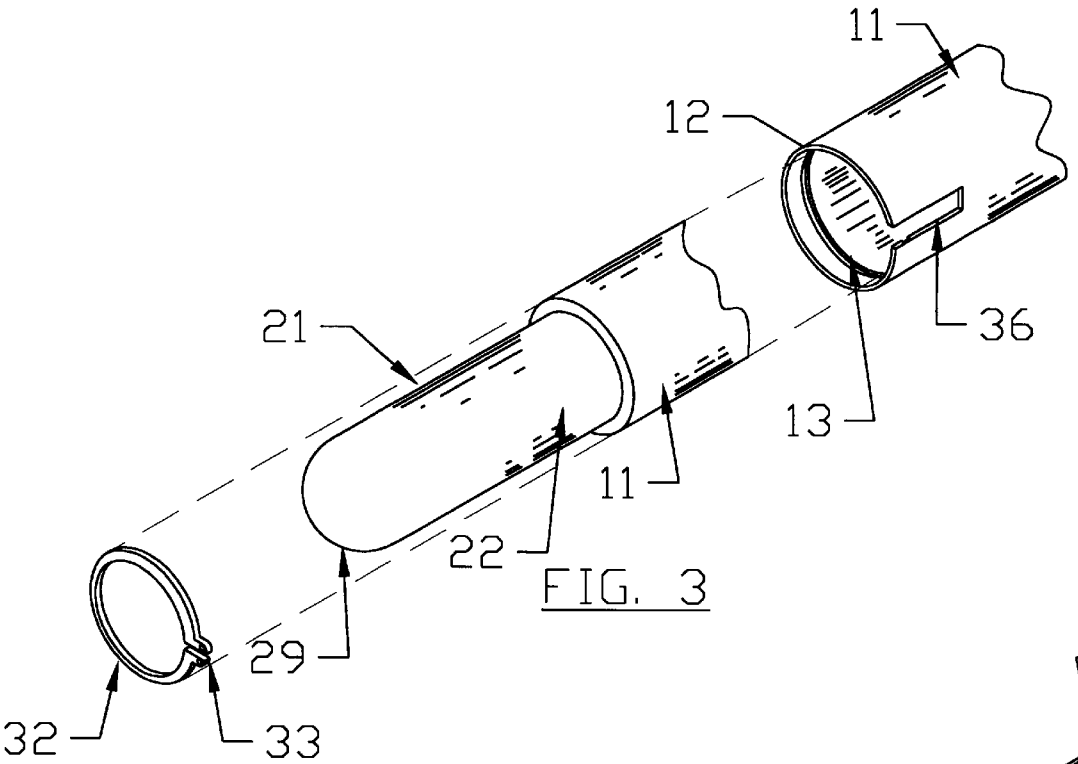
FIG. 3 is an exploded partial perspective view of the present invention.
Figure 4:
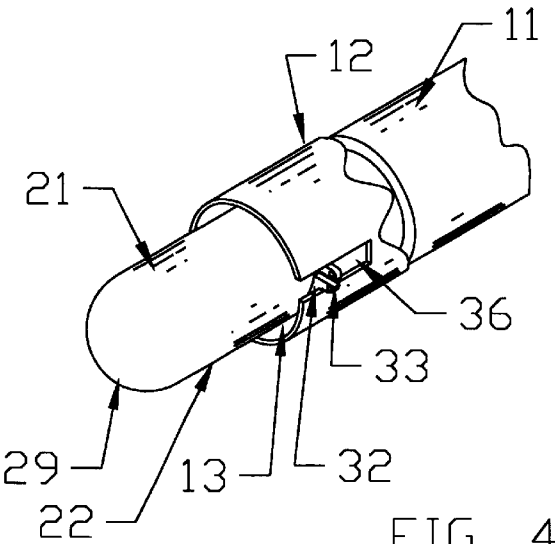
FIG. 4 is a partial perspective view of the present invention.

With reference now to the drawings, and in particular to FIGS. 1 through 4 thereof, a new punch tool embodying the principles and concepts of the present invention and generally designated by the reference numeral 10 will be described.

As best illustrated in FIGS. 1 through 4, the punch tool 10 generally comprises an elongate housing 11 including a first end 12 having an opening 13 therethrough and also including a second end 37 having an opening 14 therethrough and further including a bore 16 extending therethrough. The elongate housing 11 has a second end portion 15 which is tapered inwardly. The elongate housing 11 also includes an inner wall 24 which defines the bore 16 of the elongate housing 11. The inner wall 24 includes a first portion 25 and a second portion 26 which has a circumference which is relatively smaller than a circumference of the first portion 25 of the inner wall 24 thus forming a first ledge 27 at a juncture of the first and second portions 25,26 of the inner wall 24.

A handle member 17 is securely and conventionally attached about the elongate housing 11 near the first end 12 thereof with the handle member 17 being essentially a collar-like member which is securely attached about the elongate housing 11. A fastener holding member 18 is conventionally connected to the second end 37 of the elongate housing 11 with the fastener holding member 18 being essentially a slender tubular member 18 having openings in ends 19 thereof and having a bore 20 extending therethrough. The fastener holding member 18 has a circumference relatively smaller than a circumference of the elongate housing 11 and also has the bore 20 which has a diameter which is relatively smaller than a diameter of the bore 16 of the elongate housing 11 with the fastener holding member 18 being essentially magnetized for holding onto a metal fastener 34.

A means for punching a fastener being held by the fastener holding member 18 includes a first shaft member 21 being movably disposed in the bore 16 of the housing 11 and having a first end 29 and a second end and further having a first portion 22 and a second portion 23, and also includes a second shaft member 30 which is securely and conventionally attached to the second portion 23 of the first shaft member 21 and which is movable through the bore 20 of the fastener holding member 18 for driving a fastener 34, and further includes a spring 31 being disposed in the bore 16 of the elongate housing 11 and being disposed about the second portion 23 of the first shaft member 21 for biasing the first end 29 of the first shaft member 21 out of the elongate housing 11 through the first end 12 thereof, and also includes a shaft retaining member 32 being securely and conventionally attached about the first shaft member 21 near the first end 29 thereof with the first portion 22 of the first shaft member 21 having a circumference relatively larger than a circumference of the second portion 23 of the first shaft member 21 thus forming a second ledge 28 at a juncture of the first and second portions 22,23 of the first shaft member 21. The spring 31 is disposed between the first and second ledges 27,28. The shaft retaining member 32 is essentially a ring having a flange portion 33 extending outwardly therefrom with the elongate housing 11 also including a longitudinal slot 36 extending through a wall thereof and through the first end 12 thereof and with the longitudinal slot 36 extending along a portion of the elongate housing 11 and being adapted to receive the flange portion 33 of the shaft retaining member 32. The first end 29 of the first shaft member 21 is essentially parabolic.

In use, the fastener holding member 18 is set upon a head 35 of a nail 34 for instance, and the nail 34 is driven into the structure by a hammer or some other like tool being used to strike the parabolic first end 29 of the first shaft member 21 which moves the second shaft member 30 into contact with the nail 34 thus driving the nail 34 into the structure.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A punch tool comprising:

an elongate housing including a first end having an opening therethrough and also including a second end having an opening therethrough and further including a bore extending therethrough;

a handle member securely attached about said elongate housing near said first end thereof;

a fastener holding member being attached to said second end of said elongate housing;

a means for punching a fastener being held by said fastener holding member;

wherein said shaft retaining member is essentially a ring having a flange portion extending outwardly therefrom; and wherein said elongate housing also includes a longitudinal slot extending through a wall thereof and through said first end thereof, said longitudinal slot extending along a portion of said elongate housing and being adapted to receive said flange portion of said shaft retaining member.

2. A punch tool as described in claim 1, wherein said elongate housing has a second end portion which is tapered inwardly.

3. A punch tool as described in claim 1, wherein said handle member is essentially a collar-like member which is securely attached about said elongate housing.

4. A punch tool as described in claim 1, wherein said fastener holding member is essentially a slender tubular member having openings in ends thereof and having a bore extending therethrough, said fastener holding member having a circumference relatively smaller than a circumference of said elongate housing and also having said bore which has a diameter which is relatively smaller than a diameter of said bore of said elongate housing.

5. A punch tool as described in claim 4, wherein said means for punching a fastener includes a first shaft member being movably disposed in said bore of said housing and having a first end and a second end and further having a first portion and a second portion, and also includes a second shaft member which is securely attached to said first shaft member and which is movable through said bore of said fastener holding member for driving a fastener, and further includes a spring being disposed in said bore of said elongate housing and being disposed about said second portion of said first shaft member for biasing said first end of said first shaft member out of said elongate housing through said first end thereof, and also includes a shaft retaining member being securely attached about said first shaft member near said first end thereof.

6. A punch tool as described in claim 1, wherein said elongate housing includes an inner wall which defines said bore of said elongate housing, said inner wall comprising a first portion and a second portion, said second portion of said inner wall having a circumference being relatively smaller than a circumference of said first portion of said inner wall thus forming a first ledge at a juncture of said first and second portions of said inner wall.

7. A punch tool as described in claim 6, wherein said first portion of said first shaft member has a circumference relatively larger than a circumference of said second portion of said first shaft member thus forming a second ledge at a juncture of said fist and second portions of said first shaft member.

8. A punch tool as described in claim 7, wherein said spring is disposed between said first and second ledges.

9. A punch tool comprising:

an elongate housing including a first end having an opening therethrough and also including a second end having an opening therethrough and further including a bore extending therethrough;

a handle member securely attached about said elongate housing near said first end thereof;

a fastener holding member being attached to said second end of said elongate housing;

a means for punching a fastener being held by said fastener holding member;

wherein said elongate housing has a second end portion which is tapered inwardly;

wherein said handle member is essentially a collar-like member which is securely attached about said elongate housing;

wherein said fastener holding member is essentially a slender tubular member having openings in ends thereof and having a bore extending therethrough, said fastener holding member having a circumference relatively smaller than a circumference of said elongate housing and also having said bore which has a diameter which is relatively smaller than a diameter of said bore of said elongate housing;

wherein said means for punching a fastener includes a first shaft member being movably disposed in said bore of said housing and having a first end and a second end and further having a first portion and a second portion, and also includes a second shaft member which is securely attached to said first shaft member and which is movable through said bore of said fastener holding member for driving a fastener, and further includes a spring being disposed in said bore of said elongate housing and being disposed about said second portion of said first shaft member for biasing said first end of said first shaft member out of said elongate housing through said first end thereof, and also includes a shaft retaining member being securely attached about said first shaft member near said first end thereof;

wherein said elongate housing includes an inner wall which defines said bore of said elongate housing, said inner wall comprising a first portion and a second portion, said second portion of said inner wall having a circumference being relatively smaller than a circumference of said first portion of said inner wall thus forming a first ledge at a juncture of said first and second portions of said inner wall;

wherein said first portion of said first shaft member has a circumference relatively larger than a circumference of said second portion of said first shaft member thus forming a second ledge at a juncture of said first and second portions of said first shaft member;

wherein said spring is disposed between said first and second ledges;

wherein said shaft retaining member is essentially a ring having a flange portion extending outwardly therefrom; and wherein said elongate housing also includes a longitudinal slot extending through a wall thereof and through said first end thereof, said longitudinal slot extending along a portion of said elongate housing and being adapted to receive said flange portion of said shaft retaining member.

10. A punch tool as described in claim 9, wherein said fastener holding member is essentially magnetized for holding onto a metal fastener.

11. A punch tool as described in claim 9, wherein said first end of said first shaft member is essentially parabolic.

12. A punch tool comprising:

an elongate housing including a first end having an opening therethrough and also including a second end having an opening therethrough and further including a bore extending therethrough, said elongate housing having a second end portion which is tapered inwardly, said elongate housing including an inner wall which defines said bore of said elongate housing, said inner wall includes a first portion and a second portion which has a circumference which is relatively smaller than a circumference of said first portion of said inner wall thus forming a first ledge at a juncture of said first and second portions of said inner wall;

a handle member securely attached about said elongate housing near said first end thereof, said handle member being essentially a collar-like member which is securely attached about said elongate housing;

a fastener holding member being attached to said second end of said elongate housing, said fastener holding member being essentially a slender tubular member having openings in ends thereof and having a bore extending therethrough, said fastener holding member having a circumference relatively smaller than a circumference of said elongate housing and also having said bore which has a diameter which is relatively smaller than a diameter of said bore of said elongate housing, said fastener holding member being essentially magnetized for holding onto a metal fastener; and a means for punching a fastener being held by said fastener holding member including a first shaft member being movably disposed in said bore of said housing and having a first end and a second end and further having a first portion and a second portion, and also including a second shaft member which is securely attached to said first shaft member and which is movable through said bore of said fastener holding member for driving a fastener, and further including a spring being disposed in said bore of said elongate housing and being disposed about said second portion of said first shaft member for biasing said first end of said first shaft member out of said elongate housing through said first end thereof, and also including a shaft retaining member being securely attached about said first shaft member near said first end thereof, said first portion of said first shaft member having a circumference relatively larger than a circumference of said second portion of said first shaft member thus forming a second ledge at a juncture of said first and second portions of said first shaft member, said spring being disposed between said first and second ledges, said shaft retaining member being essentially a ring having a flange portion extending outwardly therefrom, said elongate housing also including a longitudinal slot extending through a wall thereof and through said first end thereof, said longitudinal slot extending along a portion of said elongate housing and being adapted to receive said flange portion of said shaft retaining member, said first end of said first shaft member being essentially parabolic.

* * * * *